US009010867B2

(12) United States Patent
Martin et al.

(10) Patent No.: US 9,010,867 B2
(45) Date of Patent: Apr. 21, 2015

(54) STOOL WITH TILTED ORIENTATION

(75) Inventors: Kirt Martin, Alto, MI (US); Fredric Biddle, Kalamazoo, MI (US); David Eberlein, Hudsonville, MI (US); Brett Kincaid, Ada, MI (US); Mark Schoolmeester, Grand Rapids, MI (US)

(73) Assignee: Steelcase Inc., Grand Rapids, MI (US)

( * ) Notice: Subject to any disclaimer, the term of this patent is extended or adjusted under 35 U.S.C. 154(b) by 260 days.

(21) Appl. No.: 13/485,997

(22) Filed: Jun. 1, 2012

(65) Prior Publication Data

US 2013/0320727 A1 Dec. 5, 2013

(51) Int. Cl.

| | |
|---|---|
| ***A47C 9/00*** | (2006.01) |
| ***A47C 3/029*** | (2006.01) |
| ***A47C 3/16*** | (2006.01) |
| ***A47C 3/30*** | (2006.01) |

(52) U.S. Cl.

CPC . *A47C 3/029* (2013.01); *A47C 3/16* (2013.01); *A47C 3/30* (2013.01); *A47C 9/002* (2013.01)

(58) Field of Classification Search

USPC ..... 297/461, 462, 271.5, 423.41, 423.43, 297/423.44, 423.45, 423.46

See application file for complete search history.

(56) References Cited

U.S. PATENT DOCUMENTS

| | | | | |
|---|---|---|---|---|
| 832,556 | A | 10/1906 | Oviatt | |
| 2,049,539 | A | 12/1935 | Greenwood | |
| 2,218,963 | A | 10/1940 | Stephenson | |
| 2,742,953 | A | 4/1956 | Kudrna | |
| 3,312,437 | A | 4/1967 | Valerie | |
| 3,339,783 | A | 9/1967 | Hale | |
| 4,061,304 | A | 12/1977 | Schattmaier | |
| 4,130,263 | A | 12/1978 | Roericht | |
| 4,218,093 | A * | 8/1980 | Gertz | 297/423.43 |
| 4,232,901 | A | 11/1980 | Harrington | |
| 4,624,341 | A | 11/1986 | Lee | |
| 5,112,103 | A | 5/1992 | Downer | |
| 5,921,628 | A | 7/1999 | Glockl | |
| 6,003,944 | A | 12/1999 | Glockl | |
| D474,039 | S | 5/2003 | Zemp | |
| 6,739,670 | B2 | 5/2004 | Johnson | |
| 6,834,916 | B2 | 12/2004 | Volkman | |
| 7,156,790 | B2 | 1/2007 | Johnsen | |
| 7,374,517 | B2 | 5/2008 | Lockett | |
| 7,478,878 | B2 | 1/2009 | Oettinger | |
| 7,740,254 | B2 * | 6/2010 | Takemura et al. | 280/124.111 |
| 8,167,077 | B2 * | 5/2012 | Takemura et al. | 180/305 |
| 2003/0164633 | A1 | 9/2003 | Jakus | |
| 2007/0138850 | A1 * | 6/2007 | Oettinger | 297/271.5 |
| 2009/0001788 | A1 | 1/2009 | Lenz | |
| 2009/0015051 | A1 * | 1/2009 | Haeberle | 297/344.19 |
| 2009/0033135 | A1 * | 2/2009 | Haeberle | 297/344.18 |
| 2011/0095586 | A1 | 4/2011 | Fernandez | |

FOREIGN PATENT DOCUMENTS

| | | | | |
|---|---|---|---|---|
| WO | WO 9008490 A1 * | 8/1990 | | A47C 3/24 |

* cited by examiner

*Primary Examiner* — David E Allred

(57) ABSTRACT

An article of furniture is disclosed. The article of furniture comprises a stool configured to be used on a generally horizontal surface such as a floor. The stool comprises a seat and a base comprising a rounded bottom surface configured to rest upon the floor. A mass is positioned beneath the seat so that the base is at equilibrium in a first tilted orientation relative to the floor. The base can be tilted to second tilted orientation relative to the floor by tilting the rounded bottom surface of the base relative to the floor.

17 Claims, 6 Drawing Sheets

STOOL WITH TILTED ORIENTATION

FIELD

The present invention relates to an article of furniture comprising a stool.

The present invention also relates to an article of furniture comprising a stool that has a rounded bottom surface providing for a tilted orientation.

RELATED APPLICATIONS

The present application relates to the following applications: None.

BACKGROUND

Articles of furniture for use in a work environment such as seating systems, including chairs and stools, are used to provide seating surfaces for persons in the work environment.

Seating systems may be configured to promote "dynamic seating" or "postural seating" where the person seated is making weight shifts and balance adjustments while seated in order to maintain a suitable seated position or posture. For example, a large "ball" (e.g. exercise ball) may be used as a seat, particularly in the context of exercise or workout activity; the person as seated on the ball is regularly if not nearly continuously called upon to make minor (and sometimes major) adjustments of balance and shifts of weight to maintain posture and seating position. Such a dynamic seating arrangement will call upon a seated person to continue movement from time to time in order to maintain a suitable seated position or posture; a dynamic seating arrangement may also call upon the person in the seat to use (or use more heavily) muscles that typically are not used (or used heavily) by a person seated in a conventional chair. Dynamic seating arrangements are also believed to provide kinesthetic benefits for certain activities (e.g. learning and education) in addition to physical benefits.

Dynamic seating arrangements such as a "ball" in comparison with a conventional chair may not be conducive to use in an office or work environment (where attention and focus is typically required for tasks instead of posture or position in a seat); such dynamic seating arrangements may be distracting or otherwise not well-suited for a person who is engaged in office work (i.e. knowledge workers) or in collaborative tasks and activities. Such dynamic seating arrangements may also be more difficult to manage and work with in an office or work environment because of their (unconventional) shape and form; similarly such dynamic seating arrangement also may not provide an aesthetic that is well-suited for an office or work environment.

SUMMARY

An article of furniture for use in a work environment may provide the benefits of dynamic seating or postural seating but also be configured for use by a person engaged in office activities, such as knowledge work or collaborative work. The article of furniture (such as a stool) may be positioned to a tilted orientation. An article of furniture (such as a stool) with a ball-shaped or rounded bottom surface may be used in a work environment. A stool may have a rounded bottom and can be positioned in tilted orientations to provide at least some benefits of dynamic seating or postural seating. The stool may have an aesthetic appearance and configuration that is suited for an office or work environment.

A stool is configured to be used on a generally horizontal surface such as a floor. The stool comprises a seat and a base comprising a rounded bottom surface configured to rest upon the floor. A mass is positioned beneath the seat so that the base is at equilibrium in a first tilted orientation relative to the floor. The base can be tilted to second tilted orientation relative to the floor by tilting the rounded bottom surface of the base relative to the floor.

A stool is configured to be used on a generally horizontal surface such as a floor. The stool comprises a top section providing seat enclosing a second end and a base section comprising a rounded bottom surface configured to support the stool on the floor. A mass is positioned beneath the seat of the top section and offset radially relative to a central axis of the stool so that the stool is in a first tilted orientation relative to the floor when not in use. The stool can be tilted into a generally upright orientation relative to the floor by maintaining the rounded bottom surface of the base portion in contact with the floor. The stool can be tilted into a second tilted orientation relative to the floor by maintaining the rounded bottom surface of the base portion in contact with the floor.

A seating system is configured to be used on a generally horizontal surface such as a floor. The seating system comprises a top section comprising a seat and having a central area and a base section comprising a rounded bottom surface supported on the floor. A height adjustment mechanism is configured to allow the selective adjustment of the seat relative to the bottom surface supported on the floor. A mass is positioned offset from the central area of the top section so that the seat is maintained in a first tilted orientation relative to the floor when not in use. The seat can be oriented in a second tilted orientation relative to the floor by tilting the bottom surface relative to the floor.

FIGURES

DESCRIPTION

Referring to FIGS. 1-10B, articles of furniture (including components) are shown according to various exemplary embodiments. As shown, the articles of furniture comprise a seating system shown as a stool 100 and 100*a*. The articles of furniture are configured for use in a work environment, including an office area or lounge area/setting. According to any preferred embodiment, the articles of furniture comprising the seating system will be configurable to support a person or persons engaged in multiple functions, such as various work-related tasks or lounge-social interactions in the work environment.

Figure 1:
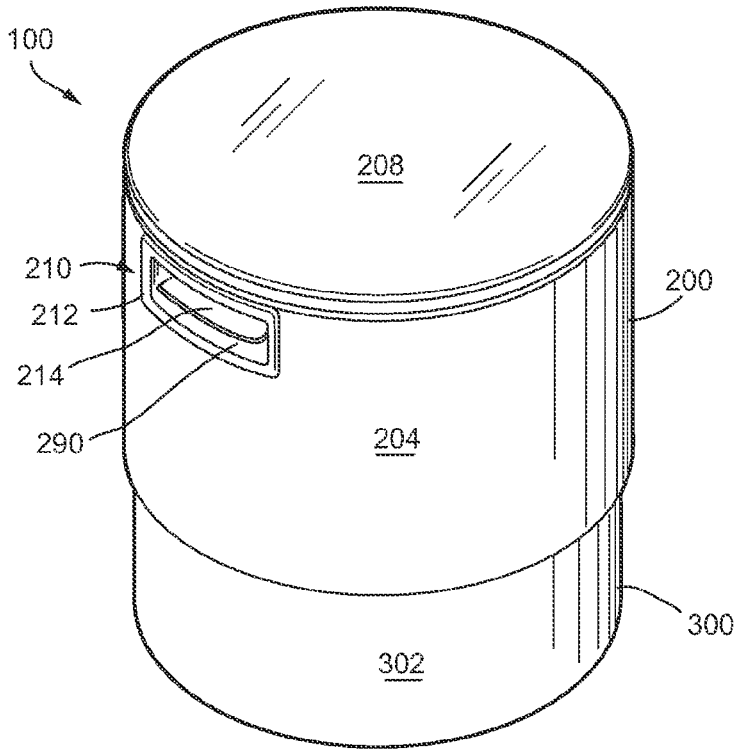
FIG. 1 is a side perspective view of an article of furniture comprising a stool according to an exemplary embodiment.
Figure 2:
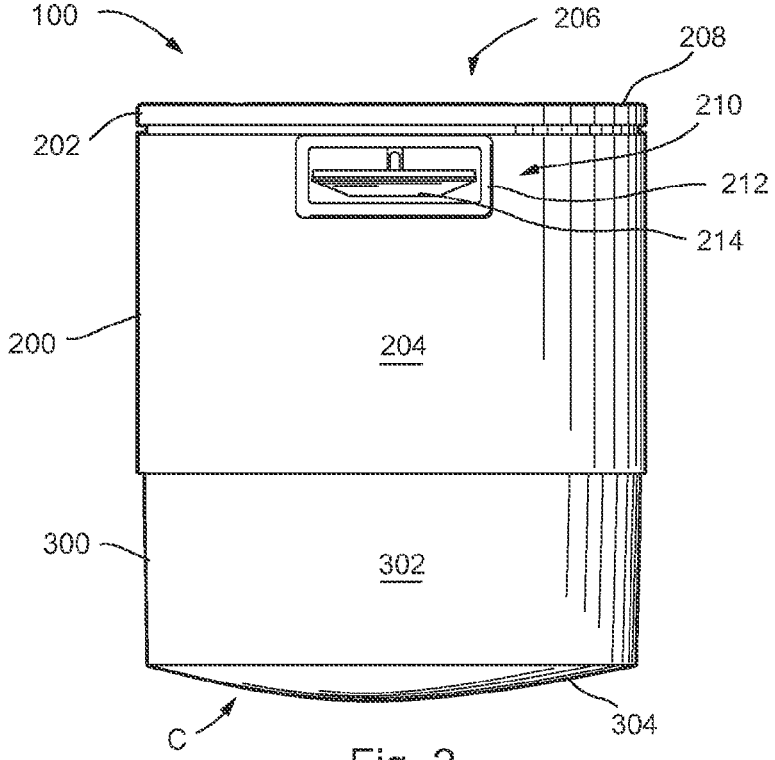
FIG. 2 is a side elevation view of the stool according to an exemplary embodiment.

Referring to FIGS. 1 and 2, an article of furniture shown as stool 100 is shown according to an exemplary embodiment. Stool 100 has a generally cylindrical form and comprises a top section 200 and a bottom section 300. Top section 200 of stool 100 comprises a top 202 with a seating surface 206 providing a pad or cushion 208. Top section 200 also comprises a shell shown as shroud 204 with an opening 210 into which a housing 212 is installed; housing 212 has an opening 290 to allow access to a handle 214 for a height adjustment mechanism 240 (see FIGS. 5A and 9). Bottom section 300 of stool 100 comprises a base 302 with a curved or rounded bottom surface 304 having a curvature C.

Figure 3:
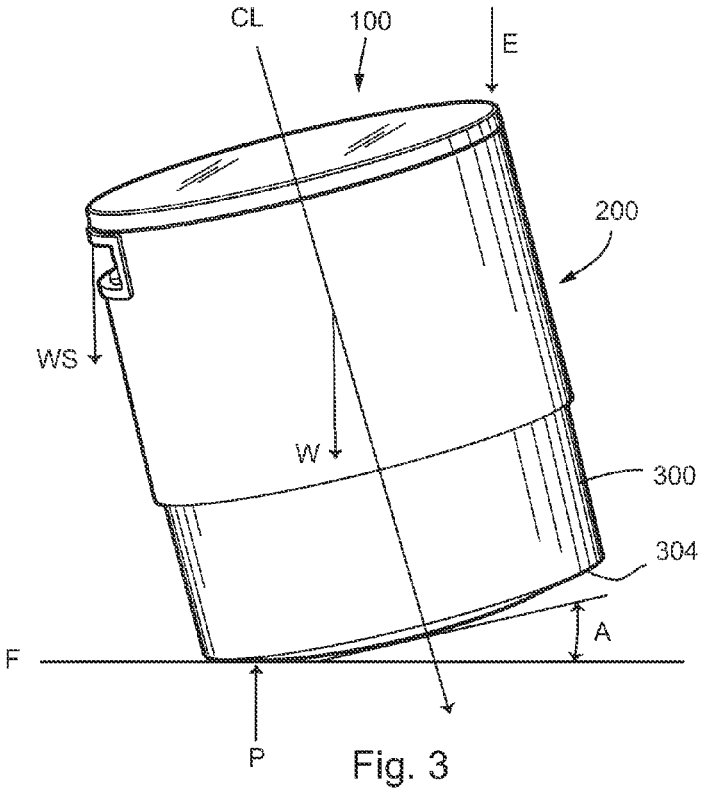
FIG. 3 is a schematic diagram of the stool in a tilted orientation according to an exemplary embodiment.
Figure 4:
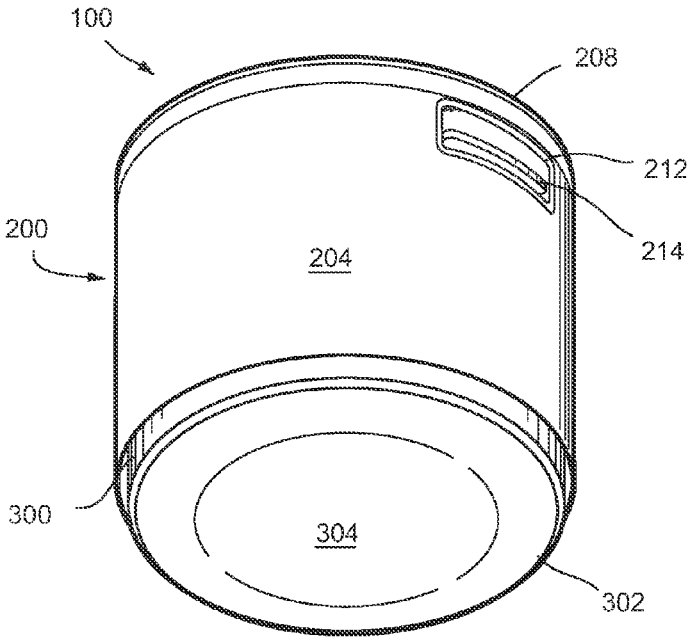
FIG. 4 is a bottom perspective view of the stool according to an exemplary embodiment.

As shown schematically in FIG. 3, stool 100 has an axial centerline CL and is configured to rest at rounded bottom surface 304 of base 302 on a generally horizontal and planar surface such as floor F. As shown in FIG. 4, rounded bottom surface 304 of base 302 of stool 100 has a partially ball-shaped or dome-shaped profile and generally rigid configuration (e.g. resembling a portion of an "exercise ball" or partial spheroid).

According to any exemplary embodiment, as shown schematically in FIG. 3, forces may cause the stool to tip or tilt relative to the floor along the rounded bottom surface. The forces may include the base weight W (e.g. mass acting through the standard center of gravity) of the stool, any supplemental weight WS (e.g. a mass offset of the centerline or standard center of gravity) from any components or counterweights (if any) provided within the stool, and any net external forces E (if any) applied to the stool (e.g. the total supported weight of a person seated on the stool and/or forces from any rocking or tilting action by the person).

As indicated in FIGS. 3 and 4, the rounded bottom surface of the base of the stool will provide a tangent plane of support coincident with the planar floor. When the stool is in a generally upright position, the point of bearing of the rounded bottom surface of the base of the stool on floor F will be in general alignment with the axial centerline of the stool; when the stool is in a tilted orientation (as shown schematically in FIG. 3), a point P of bearing of the rounded bottom surface of the base of the stool on floor F will be positioned at an offset distance from the axial centerline of the stool. Referring to FIG. 4, the tilted orientation of the stool will vary depending upon the point of the rounded bottom surface of the base the that is bearing point on the floor (and upon the profile or shape and compressibility of the surface).

The degree of tilt of the stool relative to floor F is shown schematically by angle A.

For example, as indicated schematically in FIG. 3, according to an exemplary embodiment, the effect of a supplemental mass or weight within the stool offset from the axial centerline (e.g. the weight of components of height adjustment mechanism 240 and any supplemental mass) would be to have the stool tilted at angle A relative to the floor in the absence of any applied external force or forces. The application of an external force E (shown schematically) (such the supported weight of a person seated on the stool) based upon the location and magnitude of the force may either increase or decrease or reverse the angle of tilt of stool.

Figure 5A:
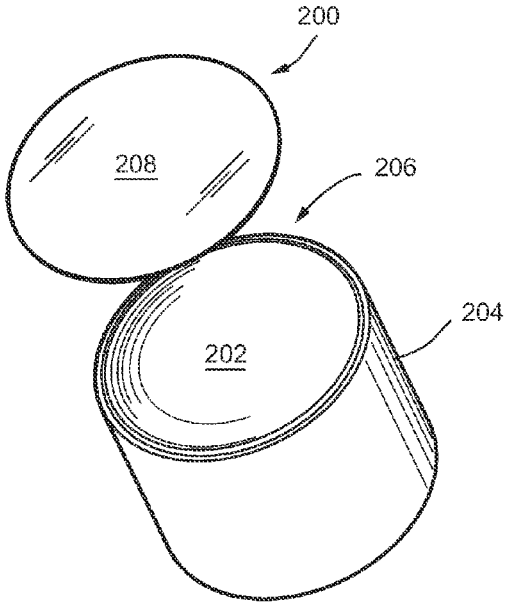
FIG. 5A is an exploded perspective view of the stool according to an exemplary embodiment.
Figure 5A:
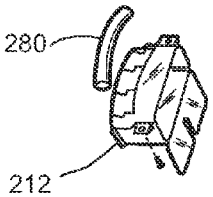
Figure 5A:
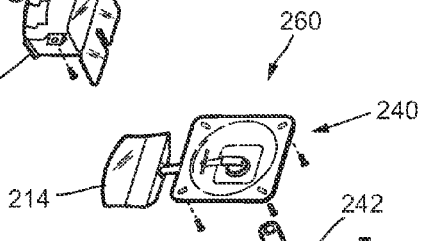
Figure 5A:
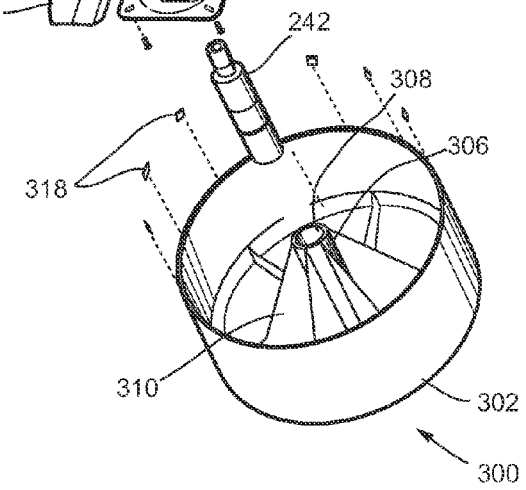
Figure 5B:
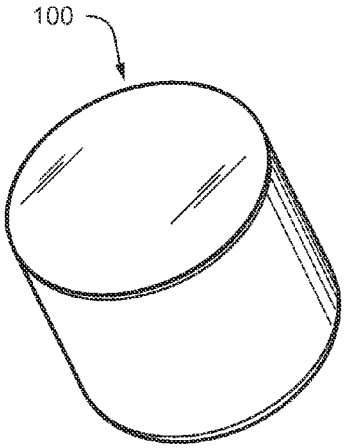
FIG. 5B is a perspective view of the stool.
Figure 9:
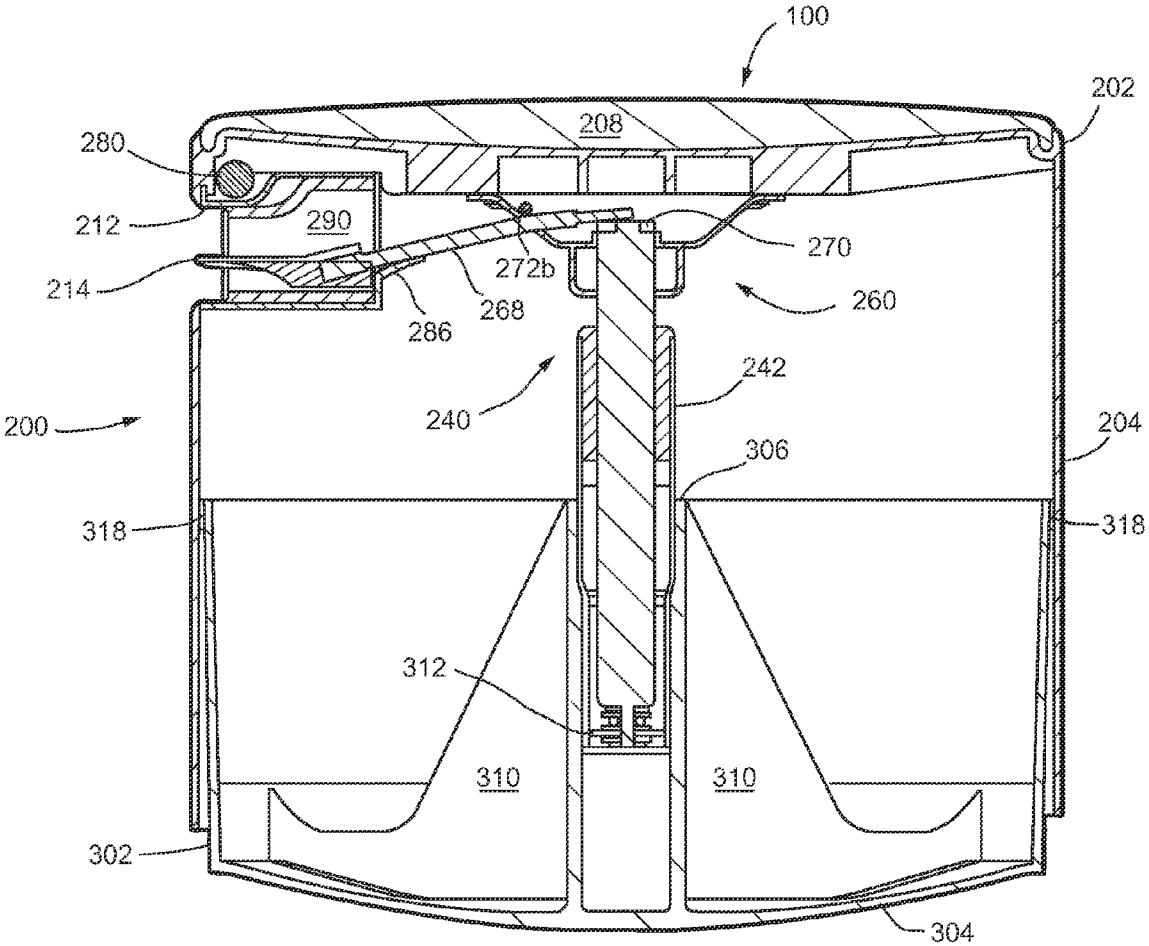
FIG. 9 is a sectional elevation view of the stool according to an exemplary embodiment.

Referring to FIGS. 1 and 5A, shroud 204 of top section 200 has a generally cylindrical form and base 302 of bottom section 300 has a generally cylindrical form. As shown in FIGS. 1-3 and 9, according to an exemplary embodiment, in the assembly of stool 100, shroud 204 is fit over base 302. As shown in FIG. 9, height adjustment mechanism 240 (e.g. comprising actuator 242) couples shroud 204 to base 302.

As shown in FIGS. 5A and 9, guides or spacers shown as pads 318 are installed around the upper exterior circumference of base 302. When shroud 204 of top section 200 is installed on base 302 of bottom section 300, pads 318 provide a spacing or separation between the exterior circumference wall of base 302 and the interior circumference wall of shroud 204. According to any preferred embodiment the pads can be provided and arranged in a manner to protect the walls of the base and the shroud from bearing/wearing and will be made of a material (e.g. felt) that will provide suitable durability/wear and friction characteristics.

As shown in FIGS. 5A and 9, base 302 comprises a generally cylindrical stem 306 with an axial opening 308 into which the bottom of actuator 242 (e.g. a telescoping actuator) of height adjustment mechanism 240 is installed. As shown in FIGS. 5A and 9, according to an exemplary embodiment, actuator is as a pneumatic cylinder 242 (e.g. telescoping actuator) that couples top section 200 to bottom section 300. A support structure 312 is provided at the base of stem 306 for installation of the bottom of actuator 242. Stem 306 is reinforced with a set of web members 310 within the interior of base 302 (e.g. to provide structural reinforcement against bearing and torsional/shearing forces that may be applied to top section 200 relative to bottom section 300 and base 302 transmitted through actuator 242). Web members 310 are also intended generally to reinforce the structure and rounded bottom surface 304 of base 302 (e.g. to hold the form of base 302 and rounded surface 304 when loading is applied to stool 100, for example, support of the total or partial weight of a seated person).

Figure 6A:
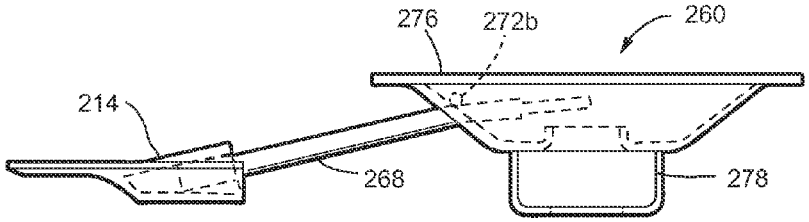
FIG. 6A is a side elevation view of a mounting structure for the height adjustment mechanism according to an exemplary embodiment.
Figure 6B:
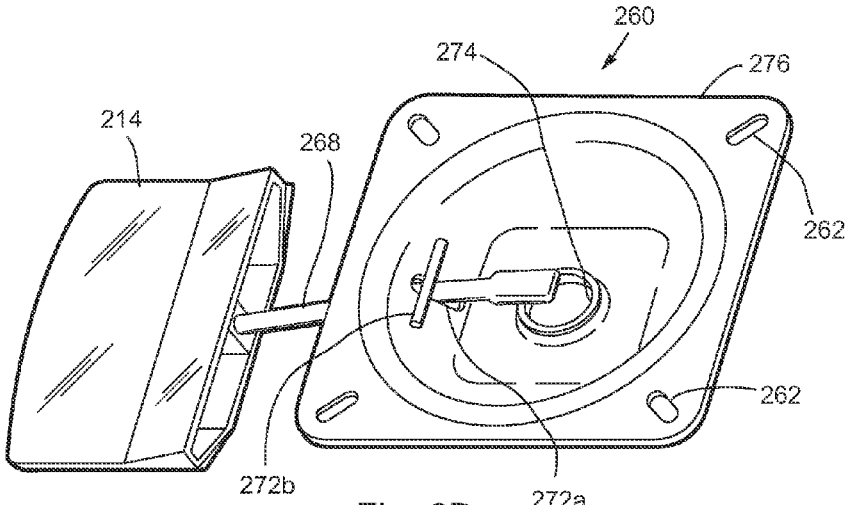
FIG. 6B is a perspective view of the mounting structure and height adjustment mechanism of FIG. 6A.

As shown in FIGS. 5A, 6A-6B and 9, a mounting structure 260 for height adjustment mechanism 240 is mounted by mounting area 276 to the interior of top 202 of top section 200 (through slots 262 by fasteners shown as screws). According to an exemplary embodiment, top 202 of top section 200 of stool 100 is rigidified and/or provided with a structure or frame providing a mounting area for mounting structure 260. The top of actuator 242 is installed through an opening 274 at the base and bottom frame 278 of mounting structure 260. Referring to FIGS. 6A-6B and 9, an arm 268 configured to depress a needle or button 270 at the top of actuator 242 extends through a slot 272 in mounting structure 260. A handle 214 is provided at the opposite end of arm 268.

As indicated in FIGS. 6A-6B and 9, according to an exemplary embodiment, lifting of handle 214 (by fulcrum action at slot 272) will actuate or depress button 270 to facilitate either expansion or compression of actuator or pneumatic cylinder 242 (at or within mechanical limits), typically according to guidance or application of force by a person facilitating or intending the adjustment of the height of top 202 and/or seating surface 206 of stool 100 relative to the floor.

Figure 7:
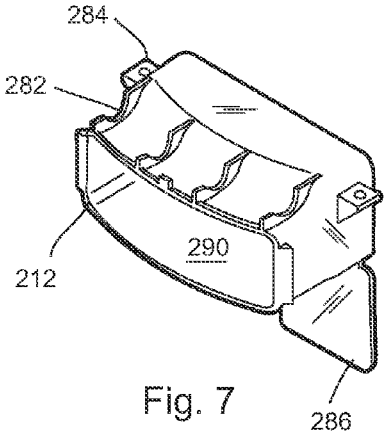
FIG. 7 is a perspective view of a housing for the top section of the stool according to an exemplary embodiment.
Figure 8A:
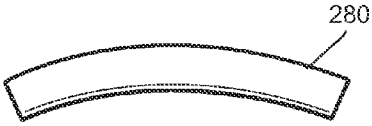
FIGS. 8A and 8B are plan and elevation views of the supplemental mass according to an exemplary embodiment.
Figure 8B:
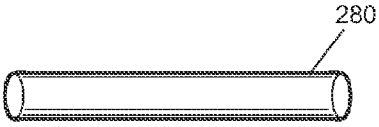

As shown in FIGS. 5A, 7 and 9, a mass shown as counterweight 280 (e.g. supplemental mass) is installed in a tray or notch 282 at the top of housing 212; when stool 100 is assembled counterweight 260 is installed in an off-center position relative to an axial centerline CL of stool 100. According to an exemplary embodiment, counterweight 280 is formed from a generally cylindrical metal bar stock and has a curved form (generally corresponding to the curvature of the stool). Housing 212 comprises mounting tabs 284 that allow mounting to a structure within the interior of top 202 (e.g. using fasteners shown as screws); housing 212 also provides a flange 286. As shown in FIG. 9, according to an exemplary embodiment, when counterweight 280 is installed in assembled stool 100 it may be fixed or entrapped within notch 282 and by the interior of top 202 of top section 200 of stool 100. According to an alternative embodiment, the supplemental mass may be a single object of a desired weight and of a unitary form or may comprise a set of weights (e.g. a plurality of weighted objects, bar, plate, mass as indicate schematically in FIGS. 10A and 10B arranged selectively to provide an intended total weight). According to an exemplary embodiment as shown schematically in FIG. 3, supplemental mass WS is positioned within the body of top section 200 of stool 100 and offset radially relative to axial centerline CL of stool 100 so that stool 100 is maintained at equilibrium in a tilted orientation relative to the floor at angle A (see FIG. 3) when not in use (i.e. when not subjected to any external forces, for example, when external force E is effectively zero).

As shown in FIGS. 3 and 4, the effect of the off-center position of counterweight 280 or mass WS relative to the axial centerline CL of stool in cooperation with the rounded bottom section is to cause the stool to be tilted relative to the floor F when in a static condition (i.e. free of any external force other than gravity). Application of an external force E will allow the stool to be tilted along the three-dimensional rounded bottom surface of base.

Figures 10A, 10B:
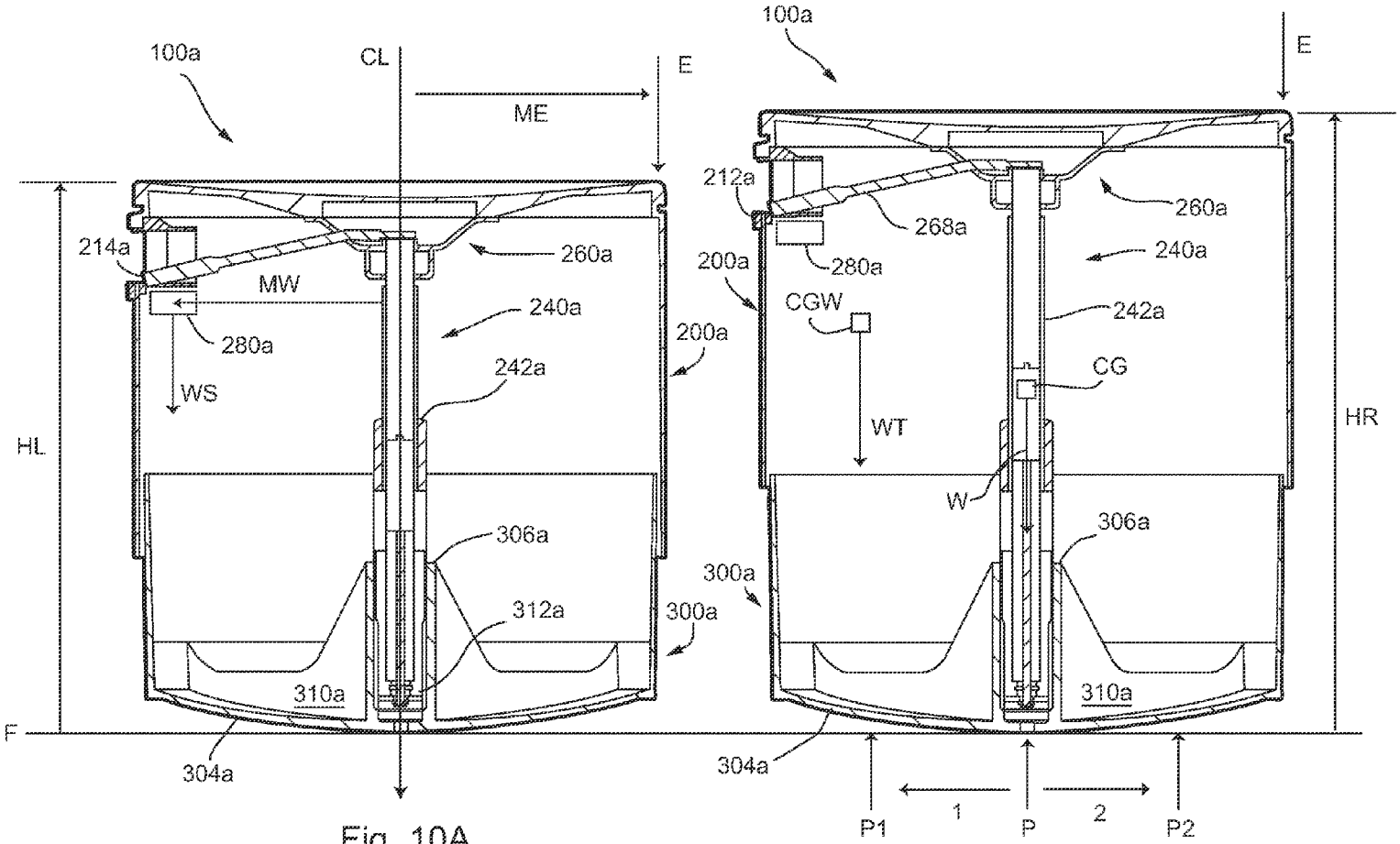
FIGS. 10A and 10B are schematic side elevation views of the stool according to an alternative embodiment.

Referring to FIGS. 10A-10B, stool 100*a* is shown according to an alternative embodiment. Stool 100*a* comprises a top section 200*a* and a bottom section 300*a*. A height adjustment mechanism 240*a* comprising an actuator shown as pneumatic cylinder 242*a* couples top section 200*a* to bottom section 300*a*. As shown, actuator 242*a* of height adjustment mechanism 240*a* is in alignment with the axial centerline CL of stool 100*a*. The top of actuator 242*a* is installed within a mounting structure 260*a* in top section 200*a*; the bottom of actuator is installed in a support structure 312*a* in a stem 306*a* in bottom section 300*a*. Height adjustment mechanism 240*a* provides an arm 268*a* with a handle 214*a* extending into a housing 212*a* through top section 200*a* at one end and into mounting structure 260*a* at the other end; lifting of handle 214*a* will actuate height adjustment mechanism 240*a*. Bottom section 300*a* includes a rounded bottom surface 304*a*. Stem 306*a* and the interior structure of bottom section 300*a* rigidifying rounded bottom surface 304*a* are structurally reinforced by a set of web members 310*a*. Stool 100*a* is supported on a floor F at a point along the rounded bottom surface 304*a* (shown as point P).

FIGS. 10A-10B show schematically the weight distribution of stool 100*a*. As shown schematically in FIG. 10A, stool 100*a* comprises a supplemental mass 280*a* having a weight WS offset from the axial centerline CL of stool 100*a* (at a position adjacent housing 212*a*); weight WS of supplemental mass 280*a* acts at a moment arm MW extended from axial centerline CL. As shown schematically in FIG. 10B, the base components and structures of stool 100*a* have a composite weight W acting through a center of gravity CG (positioned at a location generally in alignment with the axial centerline as a result of stool 100*a* having a generally cylindrical and symmetrical form). The inclusion of supplemental mass 280*a* (along with the weight of housing 212*a* and handle 214*a* and other components offset from the axial centerline) having weight WS in combination with the composite weight W of the base components and structures of stool 100*a* produces the effect of stool 100*a* having a center of gravity CGW with a total weight WT repositioned to a location that is offset from the axial centerline of stool 100*a*. In the absence of an external force, the effect of total weight WT acting at the repositioned center of gravity CGW would be to tilt stool 100*a* into a tilted orientation on floor F along rounded bottom surface 304*a* so that stool 100*a* is supported at a point P1. As shown, the application of an external force E at a moment arm ME extended from axial centerline CL may counteract the effect of offset total weight WT so that stool 100*a* is restored to a generally vertical orientation supported at point P on floor F (e.g. so that the seating surface of stool 100*a* is generally horizontal). As indicated, the application of additional external force E (e.g. representative effective net external force) may overcome the offset total weight WT so that stool 100*a* is tilted into a counter-tilted orientation on floor F so that stool 100*a* is supported at a point P2.

According to a preferred embodiment (e.g. FIG. 3), the stool is in a tilted orientation (e.g. supported at point P1 shown in FIG. 10B) when the stool is not under any external force; the application of an external force (e.g. the supported weight of a seated person using the stool) could reorient the stool into a generally horizontal orientation (e.g. supported at point P) or could orient the stool into a counter-tilted orientation (e.g. supported at point P2). As is indicated in FIGS. 10A-10B (and FIGS. 3 and 9), the stool in use can be oriented into any of a wide variety of tilted and counter-tilted orientations that may locate the point of support of the stool on the three-dimensional rounded bottom surface between or beyond points P1 or points P2 (at least for temporary periods) when under a corresponding external force E. As is indicated, removal of the external force E (e.g. as when a person who was seated on the stool rises and walks away) will result in the stool resuming a tilted orientation relative to floor F in response to offset total weight WT and location of the center of gravity CGW. According to any exemplary embodiment, the orientation of the stool relative to the floor will be determined by the three-dimensional profile of the rounded bottom surface and the net effect of the forces acting on the stool. The ability of a person using the stool as a seat to tilt and counter-tilt (orient and reorient) the stool provides benefits of "dynamic seating" and/or "postural seating" (e.g. inviting improved seating posture).

FIGS. 10A-10B also show schematically the effect of the operation of height adjustment mechanism 240*a* of stool 100*a*. As shown schematically in FIG. 10A, compression of pneumatic cylinder 242*a* will allow the decrease the height of the top section 200*a* relative to bottom section 300*a* (and to floor F) for example to height HL. As shown schematically in FIG. 10B, expansion of pneumatic cylinder 242*a* will increase the height of top section 200*a* relative to bottom section 300*a* (and to floor F) for example to height HR. Compression and expansion of height adjustment mechanism 240*a* can be effected by a person accessing handle 214*a*. According to any preferred embodiment, the height adjustment mechanism comprises a conventional actuator (shown as a telescoping pneumatic cylinder) suitable for the required loads of the stool; according to alternative embodiments, the height adjustment mechanism may comprise any suitable actuator or mechanism configuration.

As shown in FIGS. 1-4, 9 and 10A-10B, the rounded bottom surface of the stool comprises a substantially ball- or dome-shaped surface (e.g. at least partially). According to other exemplary embodiments, the rounded bottom surface may comprise an at least partially a spheroid cap or an at least partially an oblate spheroid cap or another curved shape. According to any preferred embodiment, the rounded bottom surface of the stool will comprise a three-dimensional curved surface. See also FIGS. 10A-10B.

According to an exemplary embodiment, the stool will in use provide a range of angular orientation of between approximately 0 degrees from vertical and approximately 12.5 degrees from vertical. According to a preferred embodiment, the total weight of the stool is in a range or approximately 18 to 23 pounds and the weight of the supplemental mass or counterweight is approximately 0.75 pounds. According to a particularly preferred embodiment, the stool has a cylindrical form with a diameter of approximately 15-20 inches and a seating surface presented at a height of between approximately 17 inches and 23 inches (by virtue of the height adjustment mechanism).

According to a particularly preferred embodiment, the articles of furniture will provide an attractive and inviting aesthetic appearance and comfortable postural support for persons in the work environment. As indicated schematically in FIG. 3, when in an "at rest" position the stool presents a slightly tipped or tilted position (along with the curvature of the bottom surface) that indicates as a visual cue that the stool has a dynamic form that allows it to be tilted or tipped.

The articles of furniture (including the seating system) may use any suitable materials of construction for the various structures and components, for example, metal, wood, plastics and composite materials, combinations of materials, as well as coverings such as fabric or plastic or other types of covering (i.e. having a suitable durability and ornamental appearance). According to any exemplary embodiment, the stool and its components will be made of material of construction suitable for use in the manufacture of articles of furniture. According to a particularly preferred embodiment, the top and the base of the stool are made of a rigid molded plastic material having the strength and durability for use in the manufacture of office furniture. Other components (such as the cushion or pad for the seating surface and the exterior finish of the shroud) may be covered with a fabric material. Components of the mechanisms may be made of metal materials; components such as handles and housings may be made of rigid plastic materials.

According to alternative embodiments, the articles of furniture may be provided in any of a wide variety of configurations and ornamental appearances, including arrangements or collections that may be positioned on the floor in an office are or lounge area or otherwise in a work environment.

According to any exemplary embodiment, the stool may be provided in any of a wide variety of forms, profiles and shapes such as cylindrical, orthogonal, trapezoidal, rectilinear, prismatic, elliptical, rounded, curved, etc.

The construction and arrangement of the elements of the present inventions as described in this application and as shown in the FIGURES is illustrative only. Although certain exemplary embodiments of the present inventions have been described in detail in the present application, those skilled in the art who review the application will readily appreciate that many modifications are possible without materially departing from the subject matter, novel teachings and advantages of the present inventions. Accordingly, all such modifications are intended to be included within the scope of the present inventions. Other substitutions, modifications, changes and omissions may be made in the design, materials of construction, components and elements, arrangement and configuration, manner of operation and use, etc. of the preferred and other exemplary embodiments without departing from the spirit of the present inventions.

The system and method of the present inventions can incorporate and comprise known components and technology or may incorporate and comprise any other applicable technology (present or future) providing the capability to perform the functions and processes/operations indicated in the FIGURES. All such technology is considered to be within the scope of the present inventions.

We claim:

1. A stool configured to be used on a generally horizontal surface such as a floor, the stool comprising:

a top section comprising a cylindrical shroud with an interior circumference wall and providing an opening at a first end of the cylindrical shroud and a seat enclosing a second end of the cylindrical shroud, the seat having a diameter generally equivalent to a diameter of the cylindrical shroud;

a base section comprising a cylindrically shaped body with an exterior circumference wall and providing an opening at a first end of the cylindrically shaped body and a rounded bottom surface at a second end of the cylindrically shaped body;

a mass installed beneath the seat of the top section within the cylindrical shroud and offset radially relative to a central axis of the stool to position the stool in a first tilted orientation; and a height adjustment mechanism for the seat with a control accessible through an opening in the cylindrical shroud of the top section, the control comprising a handle;

wherein the mass is independent of the height adjustment mechanism and is installed adjacent to the control.

2. The stool of claim 1 wherein the opening at the first end of the cylindrical shroud of the top section fits over the opening at the first end of the cylindrically shaped body of the base section such that the exterior circumference wall of the cylindrically shaped body interfaces with the interior circumference wall of the cylindrical shroud.

3. The stool of claim 1 wherein the seat provides a cushioned seating surface.

4. The stool of claim 1 wherein application of an external force can tilt the stool from the first tilted orientation to a second tilted orientation.

5. The stool of claim 1 wherein first tilted orientation is at a first angle relative to vertical; and wherein the first angle is determined by the weight of the mass relative to a total weight of the stool and a three-dimensional profile of the rounded bottom surface of the base portion.

6. The stool of claim 1 wherein the rounded bottom surface comprises a three-dimensional curved surface.

7. The stool of claim 1 wherein the stool comprises a dynamic seating arrangement wherein a user when seated on the stool can adjust the stool from the first tilted orientation to a second tilted orientation by varying a point of bearing of the bottom surface.

8. The stool of claim 1 further comprising a mechanism configured to allow the selective adjustment of the position of the seat relative to the bottom surface and wherein the mechanism comprises (a) an actuator coupling the top section to the base section and (b) a handle coupled to the actuator and accessible through an opening in the top section; and wherein the mass comprises at least a portion of the mechanism.

9. The stool of claim 8 wherein the actuator comprises a pneumatic cylinder generally in alignment with a central axis of the stool and the mass is positioned offset to the central axis of the stool.

10. The stool of claim 8 wherein the mass comprises at least one object separate from the height adjustment mechanism.

11. The stool of claim 1 further comprising a housing in the top section to allow access to the height adjustment mechanism and wherein the mass is positioned adjacent to the housing.

12. A seating system configured to be used on a generally horizontal surface such as a floor, the seating system comprising:

a top section comprising a seat and a generally cylindrical form and having a central area beneath the seat;

a base section comprising a rounded bottom surface;

a height adjustment mechanism comprising a control accessible through an opening in the cylindrical form of the top section, the control comprising a handle configured to allow the selective adjustment of the seat relative to the bottom surface; and a mass comprising a weight separate from the height adjustment mechanism;

wherein the mass is positioned adjacent to the control, beneath the seat and within the cylindrical form and offset from the central area of the top section such that the center of gravity of the seating system is positioned offset from the center area.

13. The seating system of claim 12 wherein the base section comprises a generally cylindrical form with a rigidified structure; and wherein the seat can be leaned from a tilted orientation to at least a generally horizontal orientation.

14. The seating system of claim 12 wherein the handle is positioned within the generally cylindrical form of the top section.

15. The seating system of claim 12 wherein the center area comprises a center axis.

16. The stool of claim 1 further comprising one or more pads positioned between the interior circumference wall of the cylindrical shroud and the exterior circumference wall of the cylindrically shaped body.

17. The seating system of claim 12 wherein the base section comprises a rigidified molded plastic structure.

* * * * *

UNITED STATES PATENT AND TRADEMARK OFFICE

CERTIFICATE OF CORRECTION

PATENT NO. : 9,010,867 B2
APPLICATION NO. : 13/485997
DATED : April 21, 2015
INVENTOR(S) : Martin et al.

It is certified that error appears in the above-identified patent and that said Letters Patent is hereby corrected as shown below:

In the Specification

Col. 3, lines 50-51: replace “the that is bearing” with -- that is the bearing --

Col. 3, line 62: after “such” insert -- as --

Col. 3, line 65: (2nd occurrence): after “of” insert -- the --

Col. 5, line 8: “indicate” should be -- indicated --

Col. 5, line 21: after “of” insert -- the --

Col. 5, line 26: after “of” insert -- the --

Col. 5, line 35: after “actuator” insert -- 242a --

Col. 6, line 43: after “decrease” insert -- in --

Col. 6, line 61: delete “a”

Col. 6, line 62: delete “an”

Col. 7, line 42: “are” should be -- area --

In the Claims

Col. 8, claim 5, line 39: after “wherein” insert -- the --

Signed and Sealed this
First Day of March, 2016

Michelle K. Lee

Michelle K. Lee
*Director of the United States Patent and Trademark Office*